US011470973B1

(12) United States Patent
Yu et al.

(10) Patent No.: US 11,470,973 B1
(45) Date of Patent: Oct. 18, 2022

(54) SIDEKICK STOOL

(71) Applicants: Jianyong Yu, Linhai (CN); Gang Chen, Ningbo (CN)

(72) Inventors: Jianyong Yu, Linhai (CN); Gang Chen, Ningbo (CN)

( * ) Notice: Subject to any disclaimer, the term of this patent is extended or adjusted under 35 U.S.C. 154(b) by 0 days.

(21) Appl. No.: 17/318,465

(22) Filed: May 12, 2021

(51) Int. Cl.
*A47C 7/62* (2006.01)
*A47C 16/04* (2006.01)
*A47C 9/00* (2006.01)
*A47C 7/00* (2006.01)

(52) U.S. Cl.
CPC ..... *A47C 7/628* (2018.08); *A47C 7/006* (2013.01); *A47C 7/624* (2018.08); *A47C 9/00* (2013.01)

(58) Field of Classification Search
CPC ..... A47C 7/006; A47C 7/624; A47C 7/628; A47C 9/00; A47C 9/02
USPC ..... 297/188.08–188.13, 423.29, 423.41, 297/423.39; 280/32.6
See application file for complete search history.

(56) References Cited

U.S. PATENT DOCUMENTS 1,432,612 A * 10/1922 O'Connor ..... A47D 13/043 280/87.051
2,448,427 A * 8/1948 Gordon ..... A47C 16/04 182/230
2,595,783 A * 5/1952 Griffin ..... B25H 5/00 280/32.6
3,976,155 A * 8/1976 Esch ..... E04F 21/22 D34/21
4,632,410 A * 12/1986 Bainbridge ..... A47C 13/00 297/135
4,749,209 A * 6/1988 Edmonds ..... A01K 97/22 297/188.1
5,356,197 A * 10/1994 Simic ..... A47C 13/00 280/204
5,451,068 A * 9/1995 Shockley ..... B25H 5/00 280/32.6
5,669,659 A * 9/1997 Dittmer ..... A47C 13/00 D34/24
5,707,067 A * 1/1998 Smith ..... B25H 5/00 280/32.6
6,010,187 A * 1/2000 Dallas ..... A47C 9/02 297/188.2
6,199,877 B1 * 3/2001 Shockley ..... B25H 5/00 280/32.6
6,398,234 B1 * 6/2002 Brown ..... B25H 5/00 280/30
6,425,590 B1 * 7/2002 Whiteside ..... B25H 5/00 280/32.6
6,540,301 B1 * 4/2003 Bottoms ..... A47C 9/025 135/65
6,595,590 B2 * 7/2003 Bottoms ..... A47C 9/027 297/451.3
6,733,073 B2 * 5/2004 Whiteside ..... A47C 7/62 280/32.6
6,834,868 B1 * 12/2004 Blackburn ..... B25H 5/00 280/32.6

(Continued)

*Primary Examiner* — Rodney B White
(74) *Attorney, Agent, or Firm* — Muncy, Geissler, Olds & Lowe, P.C.

(57) ABSTRACT

A sidekick stool is provided, including a frame body, including at least two support portions which are spacingly arranged; a seat body, being disposed on the at least two support portions; and a rail assembly, fixed to the seat body for a receiving unit to slide therein.

8 Claims, 8 Drawing Sheets

(56) References Cited

U.S. PATENT DOCUMENTS 6,848,586 B1 * 2/2005 Guliner ..... A47C 3/04 211/49.1
7,040,635 B1 * 5/2006 Remole ..... A47C 7/002 248/129
7,097,241 B2 * 8/2006 Tally ..... B25H 5/00 297/118
7,237,781 B2 * 7/2007 Canova ..... B25H 5/00 280/32.6
7,658,442 B1 * 2/2010 Whiteside ..... A47C 7/626 297/188.11
7,878,513 B2 * 2/2011 Damouzehtash ..... A47C 16/04 280/32.6
8,596,651 B2 * 12/2013 Canova ..... A47C 7/006 280/32.6
9,687,080 B1 * 6/2017 Thiel ..... A47C 9/02
10,932,572 B1 * 3/2021 Leggette ..... A47C 3/20
2002/0121801 A1 * 9/2002 Whiteside ..... A47C 9/02 297/188.08
2004/0032152 A1 * 2/2004 Tally ..... A47C 12/00 297/118
2007/0007799 A1 * 1/2007 Tally ..... B25H 5/00 297/118
2007/0262622 A1 * 11/2007 Tally ..... B25H 5/00 297/183.3
2008/0258515 A1 * 10/2008 Whiteside ..... B25H 5/00 297/174 R
2009/0115150 A1 * 5/2009 Hernandez ..... B25H 5/00 280/32.6
2009/0184482 A1 * 7/2009 Scott ..... B25H 5/00 280/32.6
2012/0274103 A1 * 11/2012 Kenttamaa-Squires ..... A47C 1/035 297/311
2017/0332784 A1 * 11/2017 Huang ..... A47B 83/02
2019/0200767 A1 * 7/2019 Huang ..... B25H 5/00

* cited by examiner

SIDEKICK STOOL

BACKGROUND OF THE INVENTION

Field of the Invention

The present invention relates to a sidekick stool.

Description of the Prior Art

During a decoration process (for example, fixing a car or decorating a house), a worker often has to bend down or squat down to work when being in a relatively lower space, and s/he might have lower back pain after working for a long time. In addition, tools and components are usually scattered on the ground or put in the pockets, so it is inconvenient to get the tools or components.

Nowadays, sidekick stools are provided to solve the inconvenience during the working process. In the convention sidekick stool, a stool body has a receiving plate which is open, so the number, type and size of the components and tools which can be stored are limited, and the components and tools in the receiving plate are exposed outside for a long time and are prone to be contaminated by foreign matters or dirt.

The present invention has arisen to mitigate and/or obviate the afore-described disadvantages.

SUMMARY OF THE INVENTION

The major object of the present invention is to provide a sidekick stool which provides a receiving unit which can be pulled out freely and store objects, and the objects stored in the receiving unit can be prevented from exposed outside. In addition, the sidekick stool can distribute force evenly to achieve a stable support effect, and the sidekick stool has a long service life.

To achieve the above and other objects, a sidekick stool is provided, including a frame body which includes at least two support portions which are spacingly arranged; a seat body which is disposed on the at least two support portions; and a rail assembly which is fixed to the seat body for a receiving unit to slide therein.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
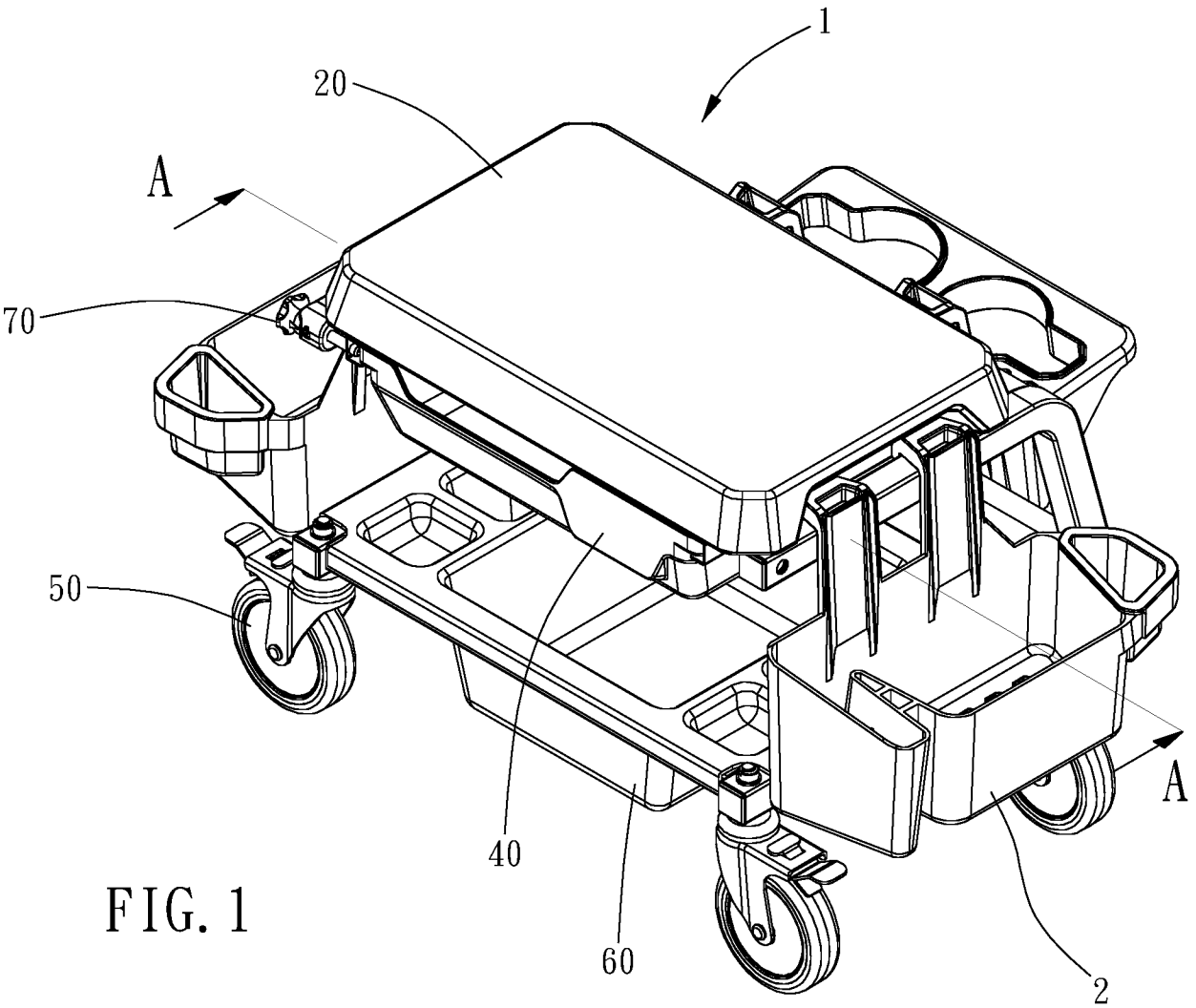
FIG. 1 is a stereogram of a preferred embodiment of the present invention.
Figure 2:
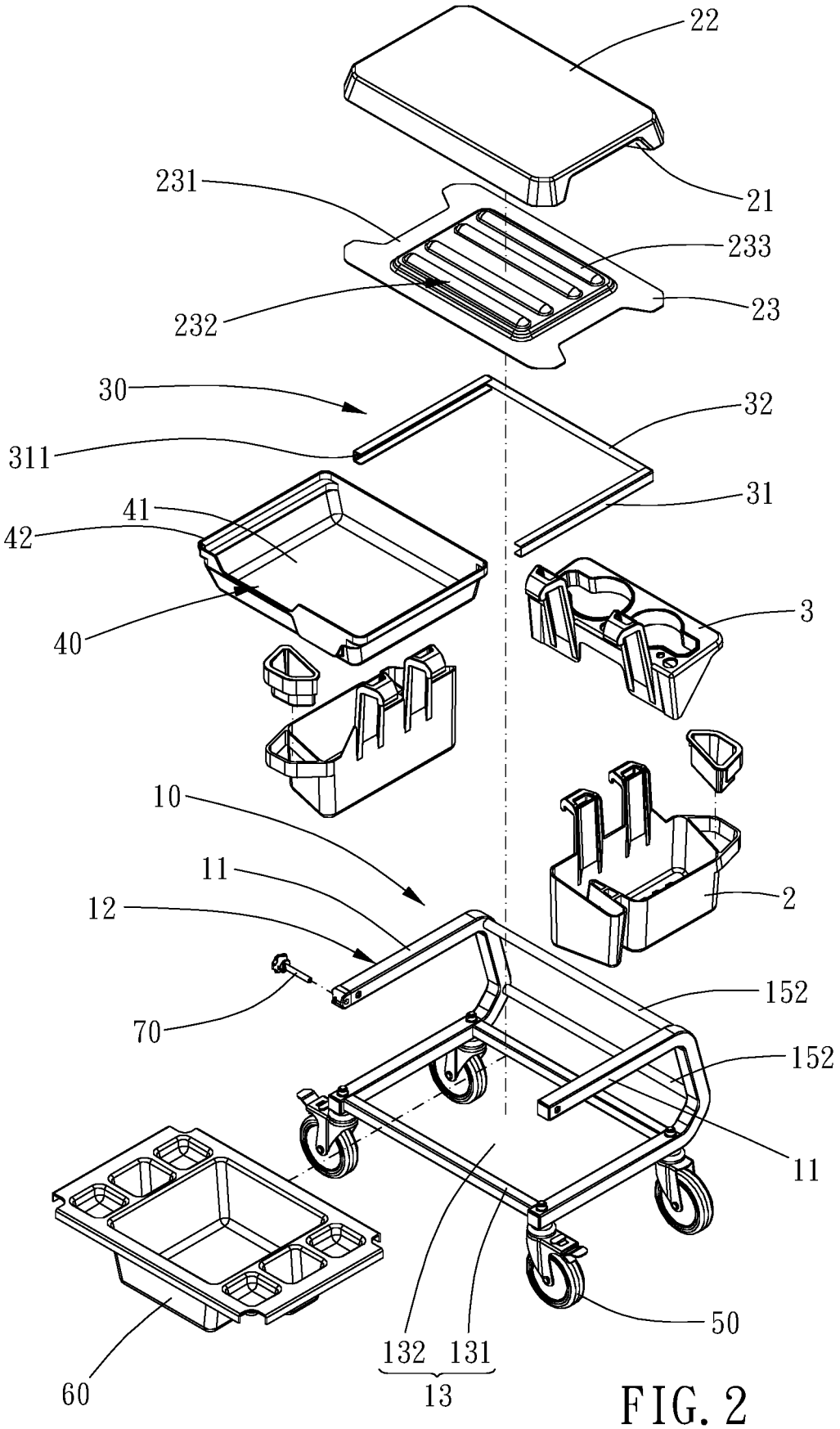
FIG. 2 is a breakdown view of the preferred embodiment of the present invention.
Figure 3:
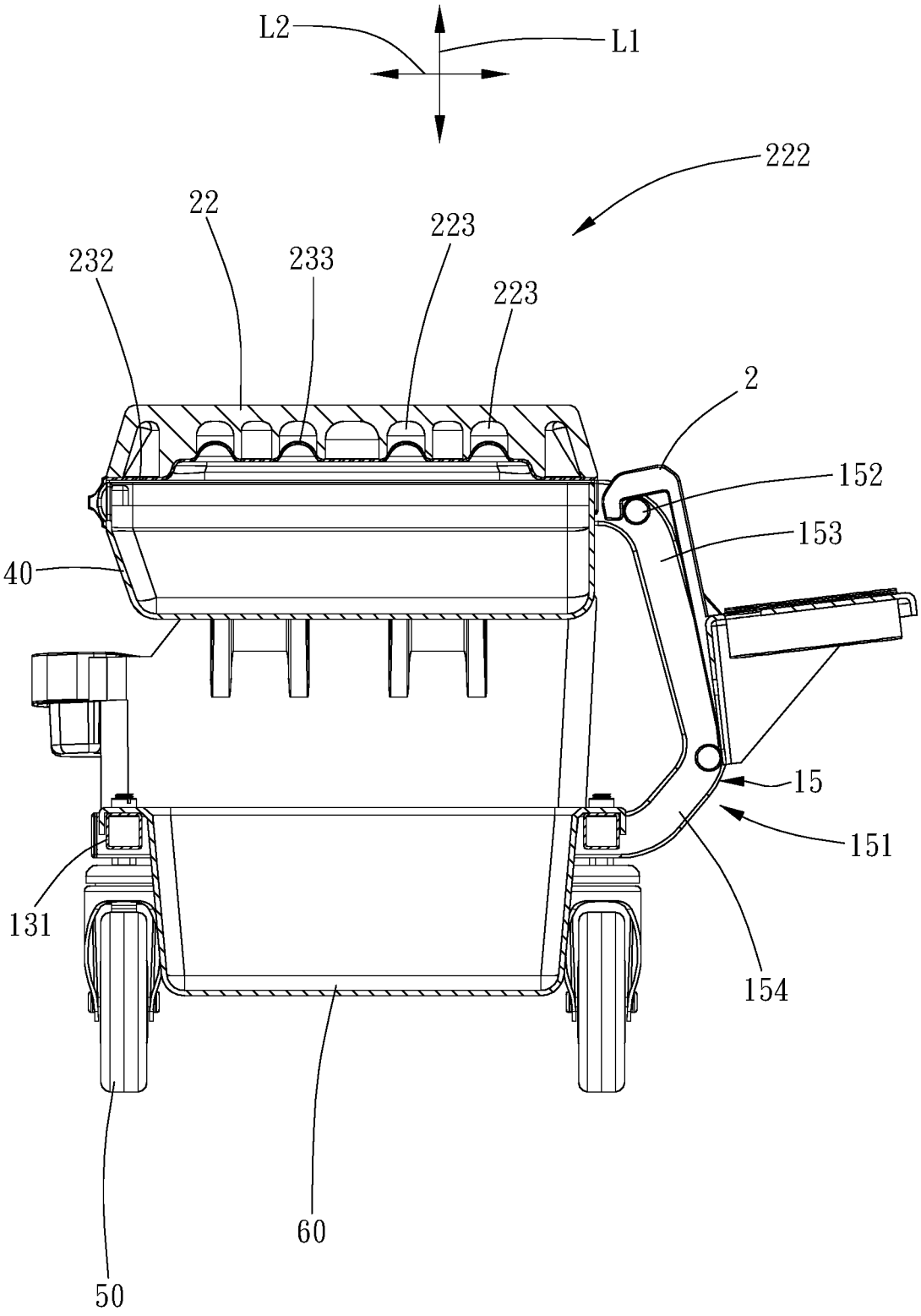
FIG. 3 is a cross-sectional view of the preferred embodiment of the present invention.
Figure 4:
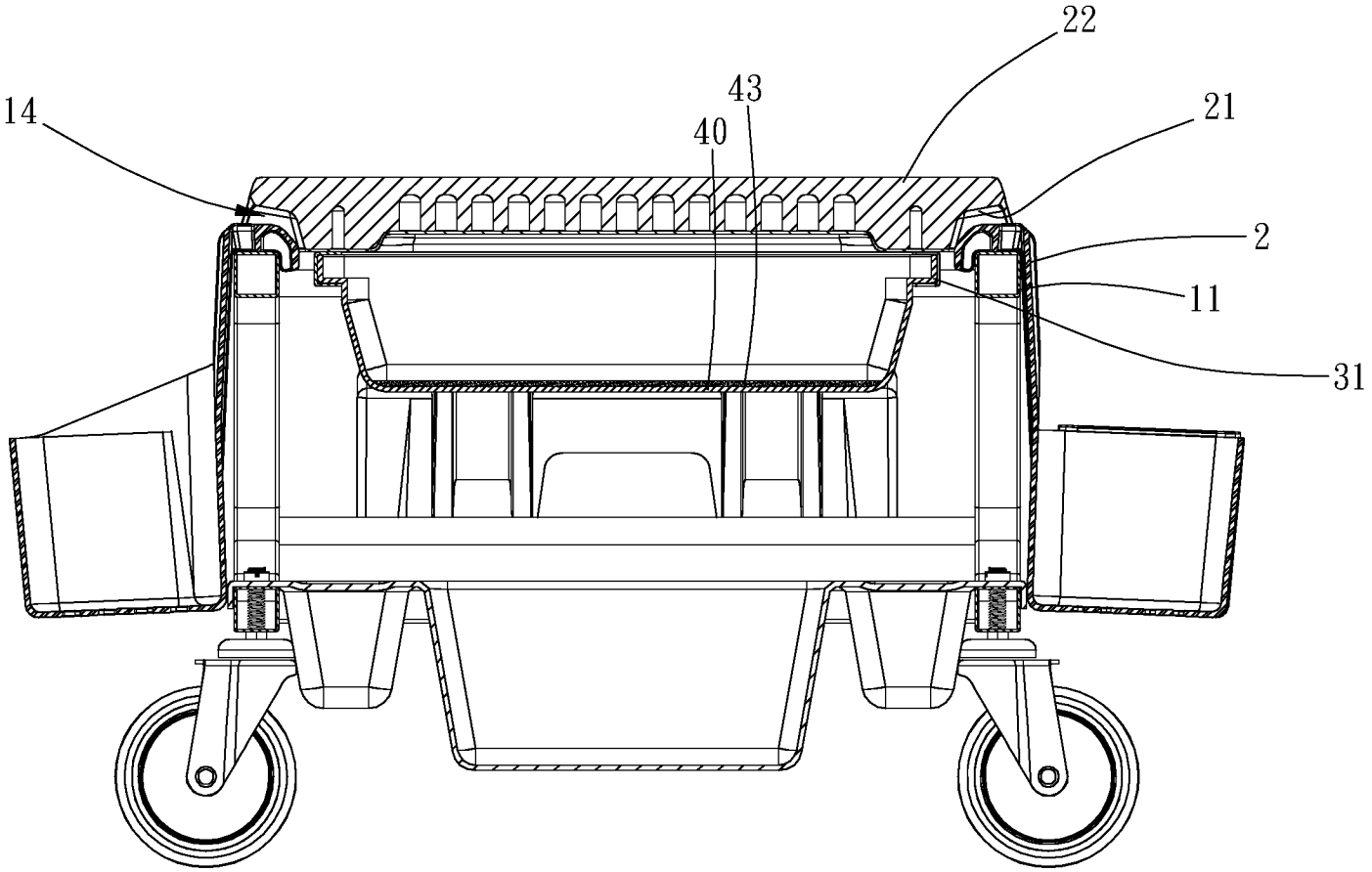
FIG. 4 is a cross-sectional view of FIG. 1, taken along line A-A.
Figure 5:
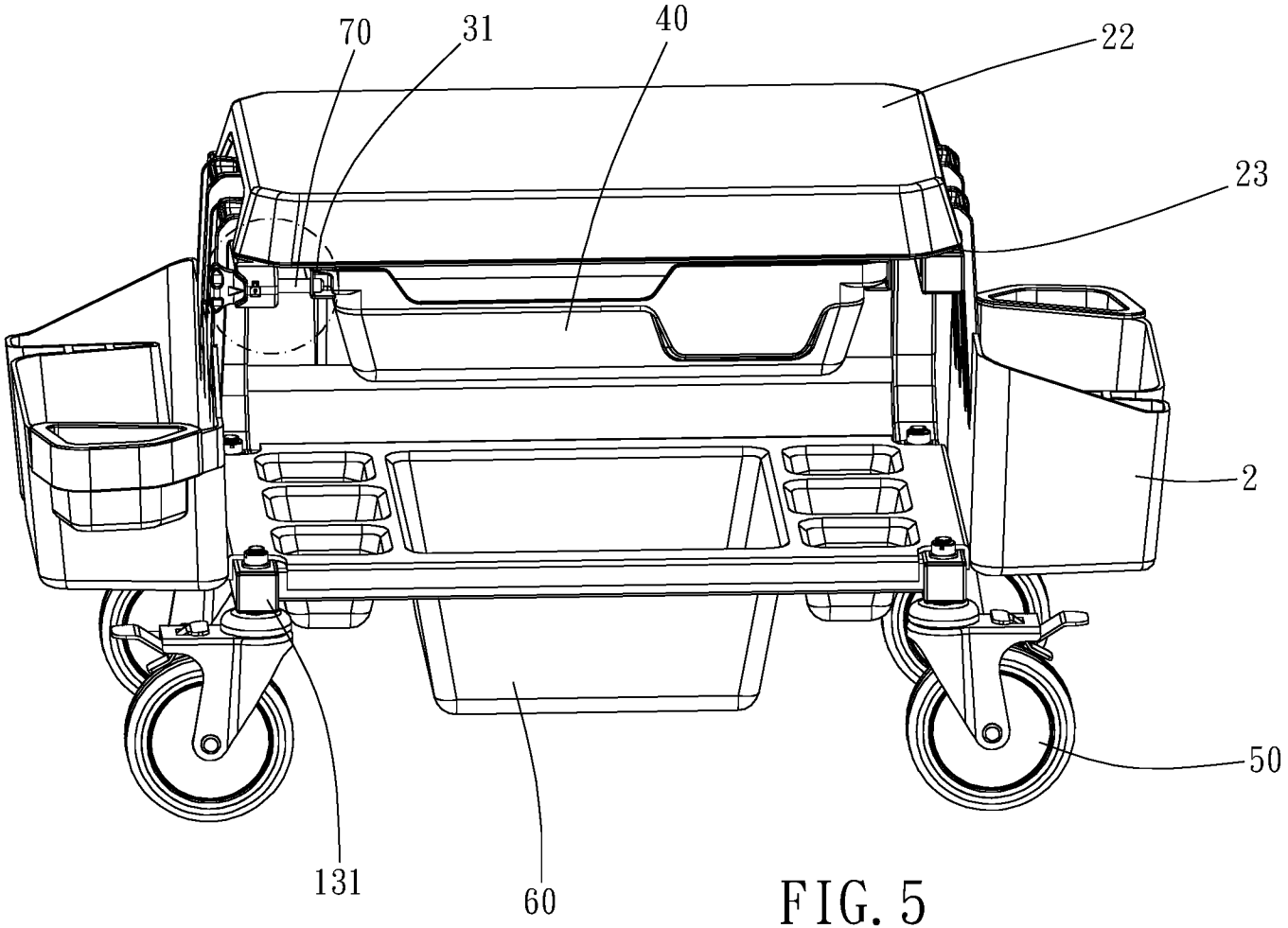
FIG. 5 is a front view of the preferred embodiment of the present invention.

The present invention will be clearer from the following description when viewed together with the accompanying drawings, which show, for purpose of illustrations only, the preferred embodiment in accordance with the present invention.

Please refer to FIGS. 1 to 8 for a preferred embodiment. A sidekick stool 1 includes a frame body 10, a seat body 20 and a rail assembly 30.

The frame body 10 includes at least two support portions 11 which are spacingly arranged; the seat body 20 is disposed on the at least two support portions 11; and a rail assembly 30 is fixed to the seat body 20, and the rail assembly 30 is for a receiving unit 40 to slide therein. Therefore, the sidekick stool 1 has a simple structure which can be easily assembled and disassembled and which distributes force evenly and has a long service life. The receiving unit 40 can be pulled out to store objects (for example, storage tools, components, electric tools, hand tools and other objects), and the objects stored in the receiving unit 40 can be prevented from being exposed outside. In addition, a user can sit on the sidekick stool 1, and it is convenient for the user to fetch the objects because s/he is close to the receiving unit 40.

The sidekick stool 1 further includes the receiving unit 40, the receiving unit 40 includes a receiving portion 41 and two sliding units 42 which are disposed on two opposite outer sides of the receiving unit 41, the receiving portion 41 is for storing tools and components, the rail assembly 30 includes two rail units 31 which are spacingly arranged, each said sliding unit 42 is slidably arranged in one of the two rail units 31, one of the at least one rail unit 31 and the at least one sliding unit 42 includes a sliding slot 312, and the other of at least one rail unit 31 and the at least one sliding unit 42 includes a restricting protrusion 421 which is slidably engaged within the sliding slot 312; in this embodiment, each said rail assembly 31 includes the sliding slot 312, and each said sliding unit 42 includes the restricting protrusion 421. The rail assembly 30 is U-shaped, the rail assembly 30 further includes a blocking wall 32, the blocking wall 32 is laterally connected to and between the two rail units 31, and the blocking wall 32 blocks the receiving unit 40.

The sidekick stool 1 further includes a plurality of wheel bodies 50, the frame body 10 includes a first carrying portion 12, the first carrying portion 12 includes the at least two support portions 11, the seat body 20 is disposed on the at least two support portions 11 on a first direction L1, the frame body 10 further includes a second carrying portion 13, the second carrying portion 13 and the first carrying portion 12 are spacingly arranged on the first direction L1, the second carrying portion 13 includes a support frame 131 and a through hole 132, the support frame 131 defines the through hole 132, the support frame 131 has the plurality of wheel bodies 50, the through hole 132 is open toward two opposite sides of the first direction L1, the support frame 131 is detachably saddled on a storage unit 60, the through hole 132 allows the storage unit 60 to be disposed therethrough to make a part of the storage unit 60 located between the plurality of wheel bodies 50 so as to quickly assemble or disassemble the storage unit 60 which has a large volume.

Figure 6:
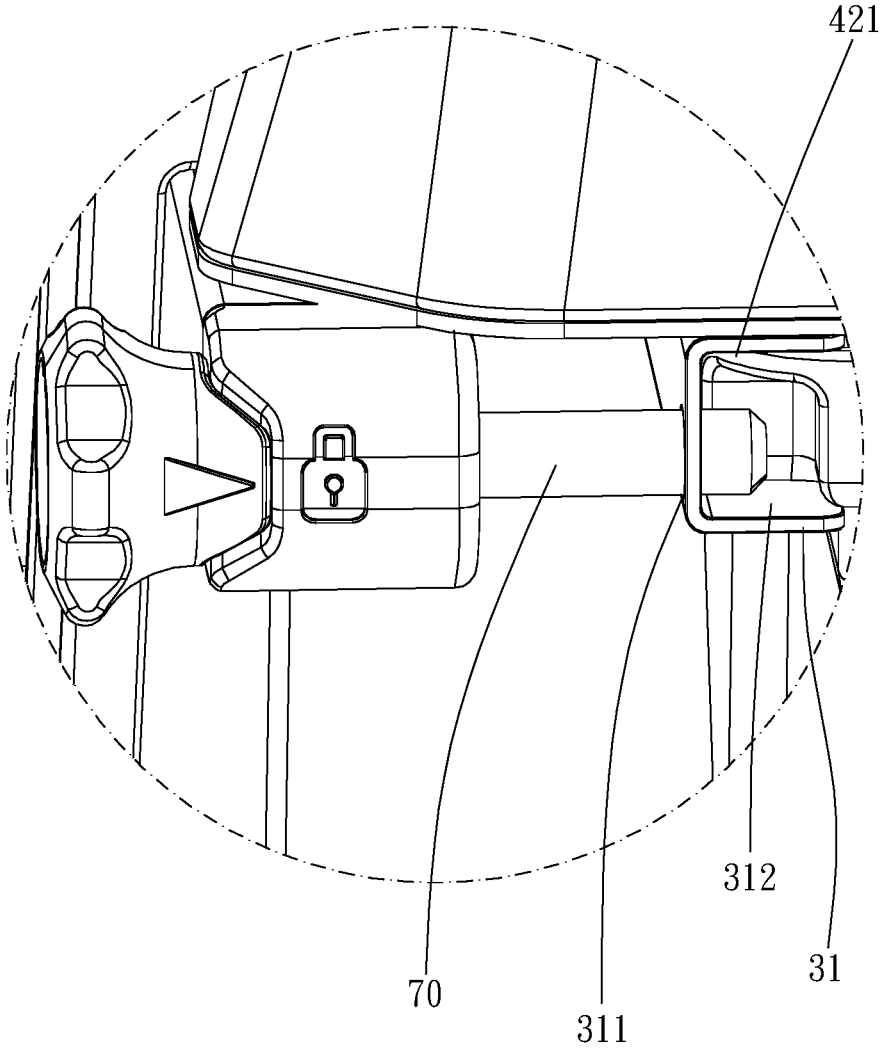
FIG. 6 is a partially enlarged view of FIG. 5.
Figure 7:
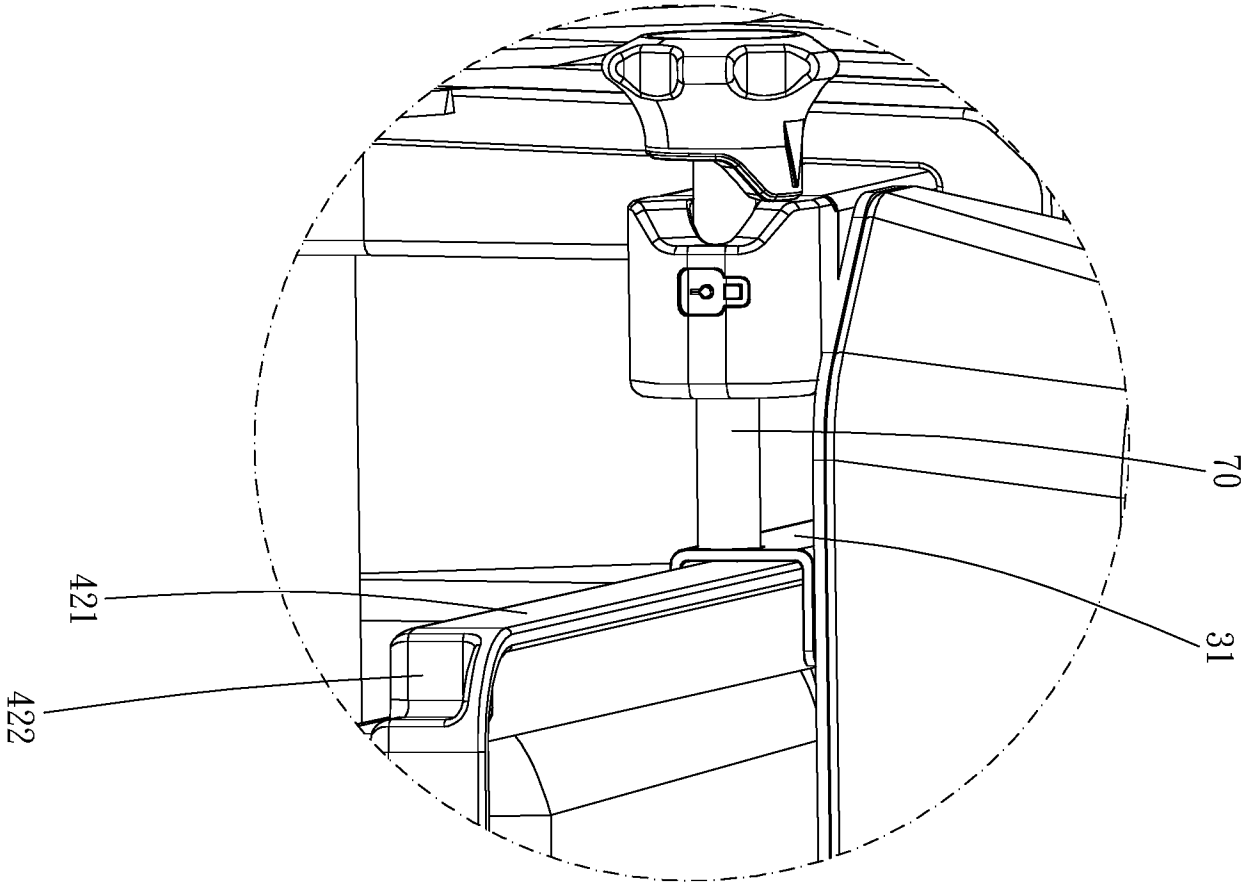
FIG. 7 is a drawing showing a positioning member on a second position of the preferred embodiment of the present invention.
Figure 8:
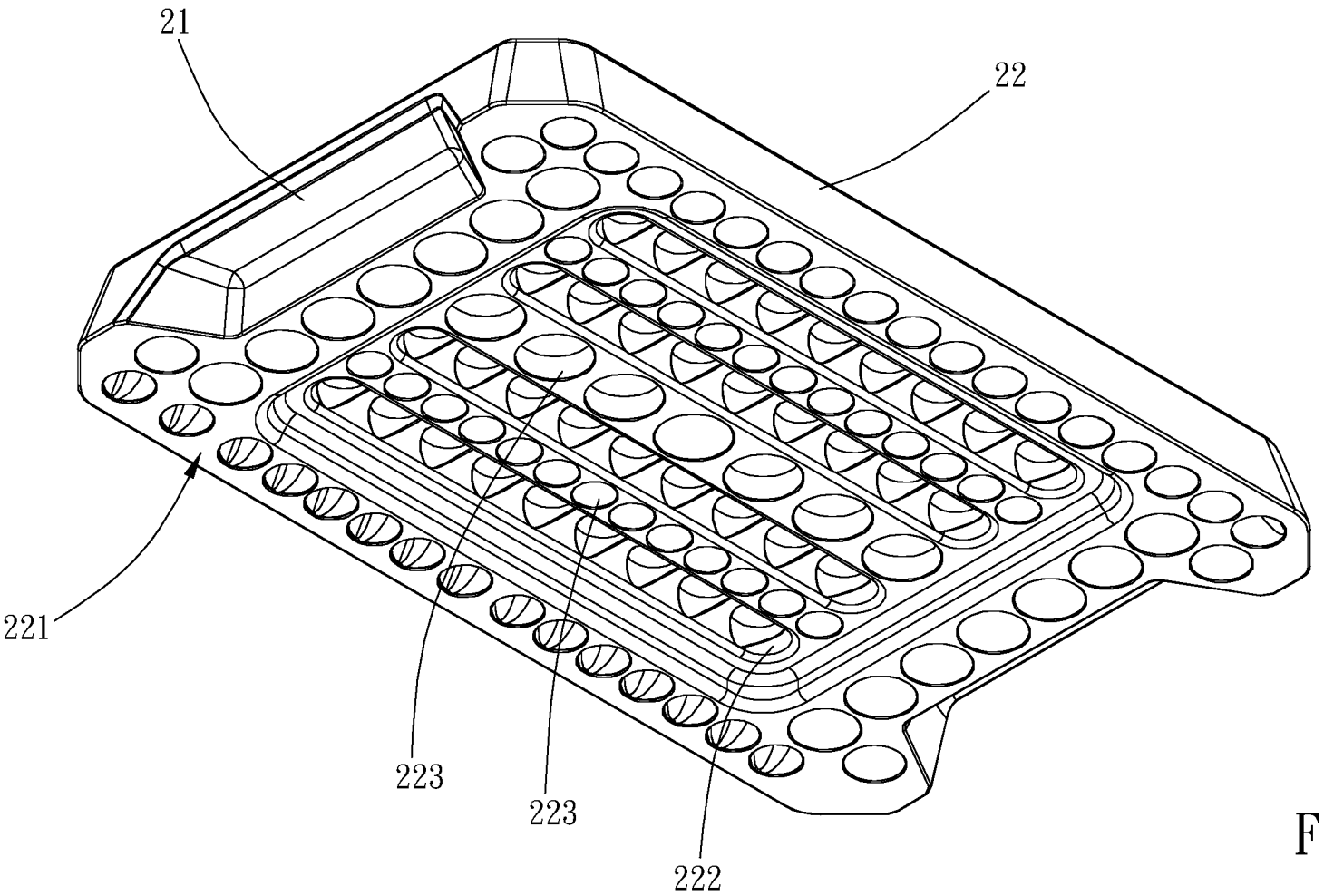
FIG. 8 is a stereogram of a pad body of the preferred embodiment of the present invention.

The sidekick stool 1 further includes a positioning member 70, the receiving unit 40 is slidably arranged on the rail assembly 30 on a sliding direction L2, and the positioning member 70 is movable to be on a first position (as shown in FIG. 6) or a second position (as shown in FIG. 7) along a direction lateral to the sliding direction L2; wherein when the positioning member 70 is on the first position, the positioning member 70 and the receiving unit 40 are engaged with each other on the sliding direction L2; when the positioning member 70 is on the second position, the positioning member 70 and the receiving unit 40 are non-interferable with each other; therefore, the positioning member 70 can either restrict and block the receiving unit 40 from sliding out or lift the restriction and pull the receiving unit 40 out. In this embodiment, each said rail unit 31 further includes a connection hole 311 which is communicable with the sliding slot 312, and the positioning member 70 is disposed through the connection hole 311 to support the rail unit 31. Specifically, the restricting protrusion 421 has a concave portion 422, and the positioning member 70 is detachably inserted within the concave portion 422.

The sidekick stool 1 includes at least one dodging space 14, the seat body 20 and at least one said support portion 11 define the dodging space 14 therebetween, the at least one dodging space 14 is open toward an outside, at least one part of the at least one said support portion 11 is exposed outside the at least one dodging space 14. The at least one outer side of the seat body 20 has a recess 21, the recess 21 and at least one said support portion 11 define the dodging space 14 therebetween, and the dodging space 14 is open toward the sliding direction L2 and the first direction L1. In this embodiment, two opposite outer sides of the seat body 20 has two said recesses 21 for a user to put his/her hand into the recess 21 to grip thereon; in addition, each said dodging space 14 allows a hook of a storage box 2 to detachably pass therethrough and hook on one said support portion 11.

The frame body 10 further includes a support vertical portion 15, the support vertical portion 15 is connected to and between the first carrying portion 12 and the second carrying portion 13, the support vertical portion 15 includes two support rods 151 which are spacingly arranged and at least one lateral rod 152 which is laterally connected to the support rod 151, each said support rod 151 is C-shaped, each said support rod 151 includes an upper tilted section 153 which is close to the seat body 20 and a lower prop section 154 which is close to the second carrying portion 13, the plurality of lateral rods 152 are respectively connected to and between the upper tilted sections 153 and the two lower prop sections 154 of the two support rods 151, and the at least one lateral rod 152 is exposed outside the seat body 20 to stably support a weight and hang at least one receiving box 3 on each said lateral rod 152. In this embodiment, the support vertical portion 15 includes the plurality of lateral rods 152 which are spacingly arranged.

The seat body 20 is detachably arranged on the at least two support portions 11. In this embodiment, the seat body 20 includes a pad body 22 and a carrying body 23, the pad body 22 may be made of a buffering material, a soft material or a flexible material, the carrying body 23 is disposed between the pad body 22 and the at least two support portions 11, and the pad body 22 is detachably disposed on the carrying body 23. Preferably, the pad body 22 has a bottom portion 221, the carrying body 23 has a top portion 231 facing the bottom portion 221, the bottom portion 221 has a first engaging portion 222, the top portion 231 has a second engaging portion 232, and the first engaging portion 222 and the second engaging portion 232 are in a male-female connection; specifically, the first engaging portion 222 includes a plurality of slots 223, each said slot 223 extends from the bottom portion 221 to the top portion 231, the second engaging portion 232 includes a plurality of protrusions 233, each said protrusion 233 is detachably inserted within one of the plurality of slots 233 to prevent the pad body 22 from sliding and provide a preferable buffering effect, and the plurality of slots 223 can be in different shapes and sizes, so the pad body 22 can be quickly assembled or disassembled to put on any place, such as a ground, for a knee to bias thereon, but not limited thereto.

A bottom portion of the receiving unit 40 further has an anti-slip structure 43, and the anti-slip structure 43 is made of silicon resin to prevent objects stored therein from sliding. In addition, the storage box 2, the receiving box 3 and the storage unit 60 may have the anti-slip structure, and different tools, components or objects can be stored based on different structures of the storage box 2, the receiving box 3 and the storage unit 60.

While we have shown and described various embodiments in accordance with the present invention, it should be clear to those skilled in the art that further embodiments may be made without departing from the scope of the present invention.

What is claimed is:

1. A sidekick stool, including:

a frame body, including at least two support portions which are spacingly arranged;

a seat body, being disposed on the at least two support portions;

a rail assembly, fixed to the seat body for a receiving unit to slide therein;

at least one dodging space, the seat body and at least one of the at least two support portions defining the dodging space therebetween, the at least one dodging space being open toward an outside, at least one part of the at least one of the at least two support portions being exposed outside the at least one dodging space.

2. The sidekick stool of claim 1, further including a plurality of wheel bodies, the frame body including a first carrying portion, the first carrying portion including the at least two support portions, the seat body being disposed on the at least two support portions on a first direction, the frame body further including a second carrying portion, the second carrying portion and the first carrying portion being spacingly arranged on the first direction, the second carrying portion including a support frame and a through hole, the support frame defining the through hole, the support frame having the plurality of wheel bodies, the through hole being open toward two opposite sides of the first direction, the support frame being detachably saddled on a storage unit, the through hole allowing the storage unit to be disposed therethrough.

3. The sidekick stool of claim 2, wherein the receiving unit includes a receiving portion and two sliding units which are disposed on two opposite outer sides of the receiving unit, the rail assembly includes two rail units which are spacingly arranged, each said sliding unit is slidably arranged in one of the two rail units, each said rail unit includes a sliding slot, and each said sliding unit includes a restricting protrusion; the rail assembly further includes a blocking wall, and the blocking wall is laterally connected to and between the two rail units; the sidekick stool further includes a positioning member, the receiving unit is slidably arranged in the rail assembly on a sliding direction, and the positioning member is movable to be on a first position or a second position along a direction lateral to the sliding direction; when the positioning member is on the first position, the positioning member and the receiving unit are engaged with each other on the sliding direction; when the positioning member is on the second position, the positioning member and the receiving unit are non-interferable with each other; each said rail unit further includes a connection hole which is communicable with the sliding slot, and the positioning member is disposed through the connection hole; at least one outer side of the seat body has a recess, the recess and at least one said support portion define the dodging space therebetween, and the dodging space is open toward the sliding direction and the first direction; a bottom portion of the receiving unit further has an anti-slip structure, and the anti-slip structure is made of silicon resin; the seat body includes a pad body and a carrying body, the carrying body is disposed between the pad body and the at least two support portions, and the pad body is detachably disposed on the carrying body; the pad body has a bottom portion, the carrying body has a top portion facing the bottom portion, the bottom portion has a first engaging portion, the top portion has a second engaging portion, and the first engaging portion and the second engaging portion are in a male-female connection; the first engaging portion includes a plurality of slots, each said slot extends from the bottom portion to the top portion, the second engaging portion includes a plurality of protrusions, and each said protrusion is detachably inserted within one of the plurality of slots; the frame body further includes a support vertical portion, the support vertical portion is connected to and between the first carrying portion and the second carrying portion, the support vertical portion includes two support rods which are spacingly arranged and a plurality of lateral rods which are laterally connected to the support rod, each said support rod is C-shaped, each said support rod includes an upper tilted section which is close to the seat body and a lower prop section which is close to the second carrying portion, the plurality of lateral rods are respectively connected to and between the upper tilted sections and the two lower prop sections of the two support rods, and the at least one lateral rod is exposed outside the seat body.

4. A sidekick stool, including:

a frame body, including at least two support portions which are spacingly arranged;

a seat body, being disposed on the at least two support portions;

a rail assembly, fixed to the seat body for a receiving unit to slide therein;

a positioning member, the receiving unit being slidably arranged on the rail assembly on a sliding direction, the positioning member being movable to be on a first position or a second position along a direction lateral to the sliding direction; wherein when the positioning member is on the first position, the positioning member and the receiving unit are engaged with each other on the sliding direction; when the positioning member is on the second position, the positioning member and the receiving unit are non-interferable with each other.

5. The sidekick stool of claim 2, wherein the frame body further includes a support vertical portion, the support vertical portion is connected to and between the first carrying portion and the second carrying portion, and the support vertical portion includes two support rods which are spacingly arranged and at least one lateral rod which is laterally connected to the support rod.

6. The sidekick stool of claim 1, wherein the seat body is detachably disposed on the at least two support portions.

7. A sidekick stool, including:

a frame body, including at least two support portions which are spacingly arranged;

a seat body, being disposed on the at least two support portions;

a rail assembly, fixed to the seat body for a receiving unit to slide therein;

wherein the seat body includes a pad body and a carrying body, the carrying body is disposed between the pad body and the at least two support portions, and the pad body is detachably disposed on the carrying body;

wherein the pad body has a bottom portion, the carrying body has a top portion facing the bottom portion, the bottom portion has a first engaging portion, the top portion has a second engaging portion, and the first engaging portion and the second engaging portion are in a male-female connection.

8. The sidekick stool of claim 7, wherein the first engaging portion includes a plurality of slots, each said slot extends from the bottom portion to the top portion, the second engaging portion includes a plurality of protrusions, and each said protrusion is detachably inserted within one of the plurality of slots.

* * * * *